US008105102B2

(12) United States Patent
Sunaga

(10) Patent No.: US 8,105,102 B2
(45) Date of Patent: Jan. 31, 2012

(54) ELECTRICAL CONNECTOR

(75) Inventor: Shiro Sunaga, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/690,477

(22) Filed: Jan. 20, 2010

(65) Prior Publication Data

US 2010/0184317 A1 Jul. 22, 2010

(30) Foreign Application Priority Data

Jan. 22, 2009 (JP) ..... 2009-011864

(51) Int. Cl.
*H01R 13/15* (2006.01)

(52) U.S. Cl. ..... 439/260

(58) Field of Classification Search ..... 439/260, 439/495, 492

See application file for complete search history.

(56) References Cited

U.S. PATENT DOCUMENTS

| | | | | |
|---|---|---|---|---|
| 7,112,079 | B2 * | 9/2006 | Miura et al. | 439/260 |
| 7,604,499 | B2 | 10/2009 | Sunaga | |
| 2006/0089036 | A1 | 4/2006 | Takai et al. | |
| 2008/0233781 | A1 | 9/2008 | Matoba et al. | |
| 2008/0311780 | A1 | 12/2008 | Sunaga | |

FOREIGN PATENT DOCUMENTS

| | | | |
|---|---|---|---|
| EP | 1049203 | | 11/2000 |
| JP | 2007-287398 | A | 11/2007 |
| JP | 2008-310964 | A | 12/2008 |
| WO | 2007/120783 | | 10/2007 |
| WO | WO2007/120783 | | 10/2007 |
| WO | WO2009/093586 | | 7/2009 |

OTHER PUBLICATIONS

EPO Search report, Apr. 19, 2010.

Office Action for Japanese Patent Application 2009-011864, Japan Patent Office, Mar. 2, 2011.

* cited by examiner

*Primary Examiner* — Tulsidas C Patel

*Assistant Examiner* — Phuong Nguyen

(74) *Attorney, Agent, or Firm* — Kubotera & Associates, LLC

(57) ABSTRACT

An electrical connector for connecting a flat conductive member includes a housing made of an electrical insulating material and including a terminal holding groove, and a terminal held in the terminal holding groove for contacting with the flat conductive member. The terminal holding groove includes a first groove portion and a second groove portion. The groove portion has a first groove width, and the second groove portion has a second groove width smaller than the first groove width. The terminal includes an upper arm portion, a lower arm portion extending in parallel with the upper arm portion, and a combining portion combining the upper arm portion and the lower arm portion. The lower arm portion includes a connecting portion accommodated in the first groove portion and to be soldered to a circuit board. The upper arm portion includes a pressing portion for pressing the flat conductive member.

10 Claims, 6 Drawing Sheets

ELECTRICAL CONNECTOR

BACKGROUND OF THE INVENTION AND RELATED ART STATEMENT

The present invention relates to an electrical connector to be connected to a flat conductive member.

Patent Reference has disclosed a conventional electrical connector (a connector) to be connected to a flat conductive member. According to Patent Reference, the conventional electrical connector includes a housing for receiving the flat conductive member such as a flexible printed circuit board (FPC) and a flexible flat cable (FFC), a plurality of terminals, and an actuator attached to the housing.

The terminals include a plurality of first terminals and a plurality of second terminals. Each of the first terminals and the second terminals is made from a metal plate by punching into an H-character shape substantially so as to maintain a plate surface of the metal plate. The terminals are pressed into and held in the housing so that the plate surfaces thereof are parallel to each other. The actuator is capable of rotating around a shaft portion thereof between an open position and a closed position. The actuator allows the flat conductive member to be inserted into the housing at the open position and allows a contact portion of the terminal to keep contacting with the flat conductive member inserted, with a contact pressure at the closed position.

Patent Reference: Japanese Patent Publication No. 2007-287398

In the conventional electrical connector, one of the first terminal and the second terminal, for example, the second terminal, includes an upper arm portion and a lower arm portion extending in a direction that the flat conductive member is inserted (an insertion direction). The second terminal further includes a combining portion combining the upper arm portion and the lower arm portion. The upper arm portion and the lower arm portion include a combined area, that is, an area thereof combined to the combining portion, respectively.

The lower arm portion includes a cable supporting portion supporting the flat conductive member from a lower direction. The cable supporting portion is situated at one end of the lower arm portion in the insertion direction. The lower arm portion further includes a connecting portion (a tail portion) to be soldered to a circuit board at other end thereof in the insertion direction. The upper arm portion includes a contact portion for contacting with the flat conductive member at one end thereof and a lever portion at other end thereof for controlling the shaft portion of the actuator not to move in an upper direction.

When the actuator rotates from the open position to the closed position after the flat conductive member is inserted into the housing, the shaft portion having an oval cross-sectional surface pushes the lever portion in the upper direction. Further, the upper arm portion rotates like a lever, as well as the combining portion deforms elastically. As a result, the contact portion of the upper arm portion moves in the lower direction, thereby contacting with a conductive line provided on an upper surface of the flat conductive member with the contact pressure. The first terminal has a similar configuration with the second terminal, except the connecting portion is provided at the end where the cable supporting portion is situated.

The housing includes a first terminal holding recess portion and a second terminal holding recess portion or terminal holding recess portions having a slit shape. The first terminal holding recess portion holds the first terminal and the second terminal holding recess portion holds the second terminal by holding the plate surfaces of the terminals, respectively.

The second terminal holding recess portion includes a narrower portion corresponding to a portion situated nearer the contact portion in relation to the combining portion of the upper arm portion, a portion situated nearer the cable supporting portion in relation to the combining portion of the lower arm portion, and the combining portion of the second terminal, respectively. The narrower portion has a width in a thickness direction of the terminal close to a thickness of the terminal. Accordingly, a width of a space generated between the plate surface of the terminal and an inner surface of the terminal holding recess portion is extremely narrow or almost zero. The narrower portion controls a shift of the second terminal in the thickness direction, thereby the second terminal is held in a proper position.

In addition, the second terminal holding recess portion includes a wider portion and a cut portion at a remaining area or an area corresponding to an area from a portion next to the connecting portion to the combined area of the upper arm portion, through the combining portion of the terminal. A width of the wider portion is sufficiently wider than the thickness of the terminal. Accordingly, at the wider portion, the second terminal holding recess portion has a space against the terminal wider than the space at the narrower portion. Consequently, the second terminal holding recess portion obtains a space with a certain width between the plate surface of the second terminal and the inner surface of the wider portion thereof, facing the plate surface of the second terminal. Further, the cut portion penetrates both side walls of the second terminal holding recess portion, thus a space is provided between the terminal and the second terminal holding recess portion at the cut portion as well.

Accordingly, when the connecting portion of the lower arm portion is soldered to the circuit board and flux flows up in the narrower portion along the plate surface of the connecting portion situated in the narrower portion due to a capillary action, the flux does not flow into the wider portion since there is the space wide enough to stop the capillary action, between the inner surface of the wider portion and the plate surface of the terminal. Thereby, it is possible to prevent the flux from flowing into further.

In the conventional connector in Patent Reference, it is possible to prevent the flux from flowing up. Accordingly, it is possible to maintain the upper arm portion movable by preventing the flux from reaching the upper arm portion through the combining portion. The first terminal holding recess portion for holding the first terminal has a similar configuration with the second terminal holding recess portion essentially.

As described later, it is preferable that the flux does not flow up thoroughly, since the terminal may receive a negative effect as the flux flows up. Therefore, for the purpose of preventing the flux from flowing up, it is preferable that the wider portion is also provided at an area corresponding to the connecting portion, that is, a portion soldered to the circuit board in order to obtain a space around the connecting portion.

When the wider portion is provided at the area corresponding to the connecting portion, the terminal is held with two narrow portions only, that is, the portion situated nearer the contact portion in relation to the combined area of the upper arm portion, and the portion situated nearer the cable supporting portion in relation to the combined area of the lower arm portion. Accordingly, the terminal tends to easily shift in the thickness direction thereof. As a result, the terminal tends to have an unstable position in the thickness direction thereof, at the wider portion.

For example, when the terminal is pressed into the terminal holding recess portion with a slight shift from a proper position, or when the terminal has a deformation such as a warpage, the wider portion is wide enough to allow the terminal to remain in the shifted position or to keep the deformation thereof in the wider portion. As a result, in the wider portion, for example, it is possible for the terminal to obtain a declination or a deformation as a whole in the thickness direction thereof (a waggle) and a deformation in which the upper arm portion and the lower arm portion deform apart from each other in the thickness direction thereof (a buckle).

As described above, when the terminal deforms in the thickness direction thereof, one of the plate surfaces of the terminals can contact with the inner surface of the wider portion. Therefore, in a case that the terminal has the waggle or the buckle, the flux provided by soldering the connecting portion can flow into the wider portion, along the plate surface contacting with the inner surface of the wider portion though the wider portion is provided around the connecting portion.

The flux flowing into the wider portion can reach the upper arm portion through the combining portion eventually. Accordingly, the upper arm portion can be adhered to an inner surface of the terminal holding recess portion with the flux, so that mobility of the upper arm portion can be seriously suffered. Moreover, when the flux reaches the contact portion of the upper arm portion, an electrical contact failure can occur between the contact portion and the flat conductive member.

In view of the problems described above, an object of the present invention is to provide an electrical connector for a flat conductive member, capable of preventing the flux from flowing up by controlling a shift of a terminal in a thickness direction, as well as providing a wider portion corresponding to where a connecting portion is provided.

Further objects and advantages of the invention will be apparent from the following description of the invention.

SUMMARY OF THE INVENTION

In order to attain the objects described above, according to a first aspect of the present invention, an electrical connector for a flat conductive member includes a housing made from an electrical insulating material and a terminal to be connected to the flat conductive member. The terminal is pressed into and held in a terminal holding groove provided in the housing and having a slit shape. The terminal is made from a metal plate so as to maintain a plate surface of the metal plate. The terminal includes an upper arm portion, a lower arm portion extending in parallel with the upper arm portion, and a combining portion combining the upper arm portion and the lower arm portion at combined areas of both of the upper arm portion and the lower arm portion. The lower arm portion is held in the terminal holding groove and includes a connecting portion to be soldered to a circuit board. The upper arm portion includes a pressing portion for pressing an upper surface of the flat conductive member in a lower direction. The pressing portion is situated at one end of the upper arm portion, on a side that the flat conductive member is inserted.

In the electrical connector for the flat conductive member, the terminal holding groove includes a first groove portion corresponding to a first area of the terminal. The first area includes the combining portion, the combined area of the lower arm portion, and a portion where the connecting portion is provided. The first groove portion has an inner width wider than a thickness of the terminal. The terminal holding groove further includes a second groove portion corresponding to a second area of the terminal. The second groove portion has the inner width narrower than that of the first groove portion and allows the second area to be inserted therein. The second area is an area other than the first area and is provided at least two spots on one of the upper arm portion and the lower arm portion, and at least one spot on the other of the upper arm portion and the lower arm portion.

In the first aspect of the present invention, the second groove portion corresponds to the second area provided at least two spots on one of the upper arm portion and the lower arm portion, and at least one spot on the other of the upper arm portion and the lower arm portion. That is, the terminal is controlled to shift in a thickness direction thereof at least with three spots. Accordingly, the terminal is held in a proper position being stable in the thickness direction even if the first groove portion corresponding to the first area where the connecting portion is provided has a broad inner width for preventing flux from flowing up. Consequently, the terminal hardly waggles or buckles, thereby providing a proper space between the plate surface of the first area of the terminal and an inner surface of the first groove portion. As a result, a capillary action does not occur in the space. Therefore, it is possible to prevent flux from flowing into the first area.

In the first aspect of the present invention, as described above, the first groove portion corresponding to the first area including where the connecting portion is provided has the inner width wider than the thickness of the terminal. Accordingly, the terminal can obtain the proper space between the first groove portion and the connecting portion. Thus, the flux does not flow up along the connecting portion when the connecting portion is soldered to the circuit board. As a result, it is possible to prevent the flux from flowing up thoroughly.

According to a second aspect of the present invention, it is preferable that the second area is situated a location other than the first area and is provided next to at least one of the combined area of the upper arm portion and the combined area of the lower arm portion. The combined area of the upper arm portion is included in the first area, and the combined area of the lower arm portion is combined with a lower portion of the combining portion. The lower portion of the combining portion is included in the first area.

In the second aspect of the present invention, the second area is provided at a position close to at least one of the combined area of the upper arm portion and the combined area of the lower arm portion. Accordingly, the second area controls the shift of the terminal in the thickness direction at a position close to the first area. When the shift of the terminal is controlled at the position close to the first area, the shift can be controlled more effectively and the terminal can be situated in proper position.

According to a third aspect of the present invention, the second area may be provided as a protrusion protruding from an edge portion of at least one of the upper arm portion and the lower arm portion.

According to a fourth aspect of the present invention, the electrical connector for the flat conductive member may further include a pressing member. The pressing member is capable of rotating between an open position for allowing the flat conductive member to be inserted and a closed position for applying a contact pressure to the pressing portion to press against the flat conductive member. Further, the pressing member may include a cam portion provided between the upper arm portion and the lower arm portion. The cam portion influences the upper arm portion at the closed position, thereby the pressing portion of the upper arm portion is pressed against the flat conductive member.

According to a fifth aspect of the present invention, the upper arm portion and the lower arm portion may be combined by the combining portion at the combined areas thereof situated at middle portions in a longitudinal direction thereof, respectively. The upper arm portion may include a pressed portion for receiving a force from the cam portion. The pressed portion may be situated at a position nearer to one end in relation to the combined area of the upper arm portion. The lower arm portion may include a branched arm branched from a position nearer to an opposite end in relation to the combined area thereof, extending toward both of an upper direction and the opposite end thereof. The branched arm may be capable of an elastic deformation and may include a contact portion for contacting with a lower surface of the flat conductive member. The contact portion may be situated at a position nearer to the opposite end of the branched arm. The lower arm portion may include the connecting portion at a position nearer to the one end side in relation to the combined area thereof and a cam guide portion between the connecting portion and the combined area thereof for guiding a rotation of the cam portion.

According to a sixth aspect of the present invention, the upper arm portion and the lower arm portion may be combined by the combining portion at the combined areas thereof situated at the middle portions in the longitudinal direction thereof, respectively. The upper arm portion may include the pressed portion for receiving the force from the cam portion. The pressed portion may be situated at the position nearer to the one end in relation to the combined area of the upper arm portion. The lower arm portion may include the branched arm branched from the position nearer to the opposite end in relation to the combined area thereof, extending toward both of the upper direction and the opposite end. The branched arm may be capable of the elastic deformation and may include the contact portion for contacting with the lower surface of the flat conductive member. The contact portion may be situated at the position nearer to the opposite end of the branched arm. The lower arm portion may include a connecting portion at a position nearer to the opposite end thereof and the cam guide portion at the position nearer to the one end in relation to the combined area thereof for guiding the rotation of the cam portion.

According to a seventh aspect of the present invention, the terminals may include a first terminal and a second terminal. The first terminal and the second terminal may be disposed alternately. The first terminal may include a first upper arm portion, a first lower arm portion and a first combining portion. The first upper arm portion and the first lower arm portion are combined by the first combining portion at combined areas thereof situated at middle portions in a longitudinal direction thereof, respectively. The first upper arm portion may include a first pressed portion for receiving the force from the cam portion. The first pressed portion may be situated at a position nearer to one end in relation to the combined area of the first upper arm portion. The first lower arm portion may include a first branched arm branched from a position nearer to an opposite end in relation to the combined area thereof, extending toward both of the upper direction and the opposite end. The first branched arm may be capable of the elastic deformation and may include a first contact portion for contacting with the lower surface of the flat conductive member. The first contacting portion may be situated at a position nearer to the opposite end of the first branched arm. The first lower arm portion may include a first connecting portion at a position nearer to the one end in relation to the combined area thereof and a first cam guide portion between the first connecting portion and the combined area thereof for guiding the rotation of the cam portion.

In the seventh aspect of the present invention, the second terminal may include a second upper arm portion, a second lower arm portion and a second combining portion. The second upper arm portion and the second lower arm portion are combined by the second combining portion at combined areas thereof situated at middle portions in a longitudinal direction thereof, respectively. The second upper arm portion may include a second pressed portion for receiving the force from the cam portion at a position nearer to the one end in relation to the combined area thereof. The second lower arm portion may include a second branched arm branched from a position nearer to the opposite end in relation to the combined area thereof, extending toward both of the upper direction and the opposite end. The second branched arm may be capable of the elastic deformation and may include a second contact portion for contacting with the lower surface of the flat conductive member. The second contact portion may be situated at a position nearer to the opposite end of the second branched arm. The second lower arm portion may include a second connecting portion at a position nearer to the opposite end thereof and a cam guide portion at a position nearer to the one end in relation to the combined area thereof for guiding the rotation of the cam portion.

As described above, in the present invention, the second groove portion corresponds to the second area, which is other than the first area and is provided at least three spots. Accordingly, the second groove portion controls the shift of the second area in the thickness direction of the terminal at three spots arranged over a whole area of the terminal. As a result, the first area is secured at the proper position in the first groove portion. Consequently, the first area obtains the space having a proper width between the plate surface thereof and the inner surface of the first groove portion.

Therefore, it is possible to prevent the flux from flowing into the first area and to maintain the upper arm portion of the terminal movable. In addition, the flux does not adhere to a surface of the terminal, thereby maintaining the surface of the terminal in good condition. In addition, the first groove portion with the width wider than the thickness of the terminal corresponds to the first area including where the connecting portion is provided in the terminal. Thus the first area obtains the space between the plate surface thereof and the inner surface of the first groove portion. Accordingly, it is possible to prevent the flux from flowing up thoroughly.

BRIEF DESCRIPTION OF THE DRAWINGS

FIGS. 1(A) and 1(B) are sectional perspective views showing an electrical connector (a connector) and a flat conductive member to be connected to the connector according to an embodiment of the present invention, wherein FIG. 1(A) is a sectional perspective view showing the connector and the flat conductive member cut along a plane parallel to a plate surface of a terminal at a location where a first terminal is situated, and FIG. 1(B) is a sectional perspective view showing the connector and the flat conductive member cut along a plane parallel to the plate surface of the terminal at a location where a second terminal is situated;

FIGS. 2(A) and 2(B) are sectional views showing the connector taken along planes parallel to the plate surface of the terminal according to the embodiment of the present invention, wherein FIG. 2(A) is a sectional view showing the connector taken along the plane at a location where the first terminal is situated, and FIG. 2(B) is a sectional view showing the connector taken along the plane at a location where the second terminal is situated;

FIGS. 3(A) and 3(B) are sectional views showing terminal holding grooves of a housing of the connector shown in FIGS. 2(A) and 2(B) according to the embodiment of the present invention, wherein FIG. 3(A) is a sectional view showing a first terminal holding groove, and FIG. 3(B) is a sectional view showing a second terminal holding groove;

DETAILED DESCRIPTION OF THE PREFFERRED EMBODIMENTS

Hereunder, an embodiment of the present invention will be explained with reference to the accompanying drawings.

Figure 1A:
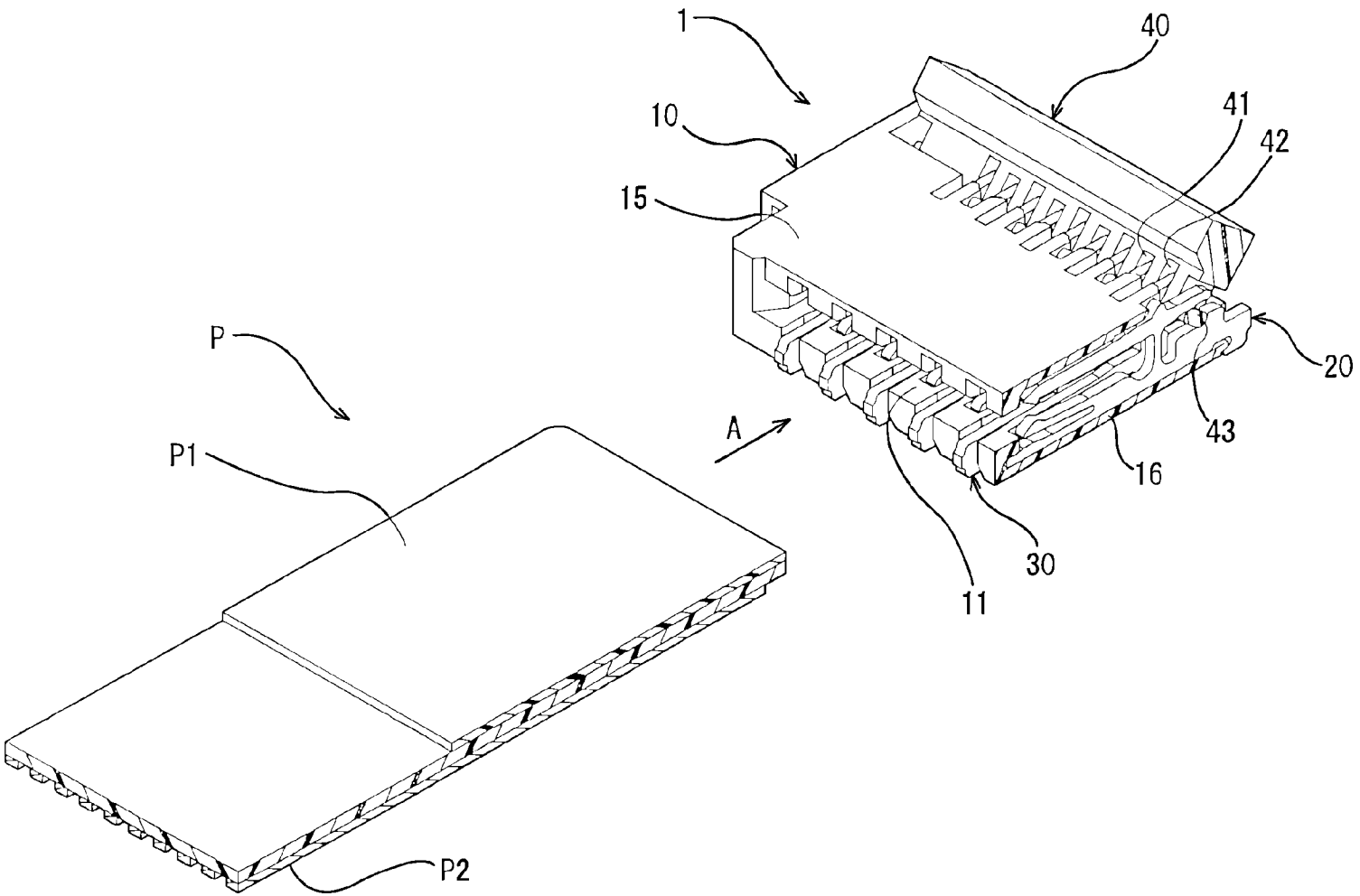
Figure 1B:
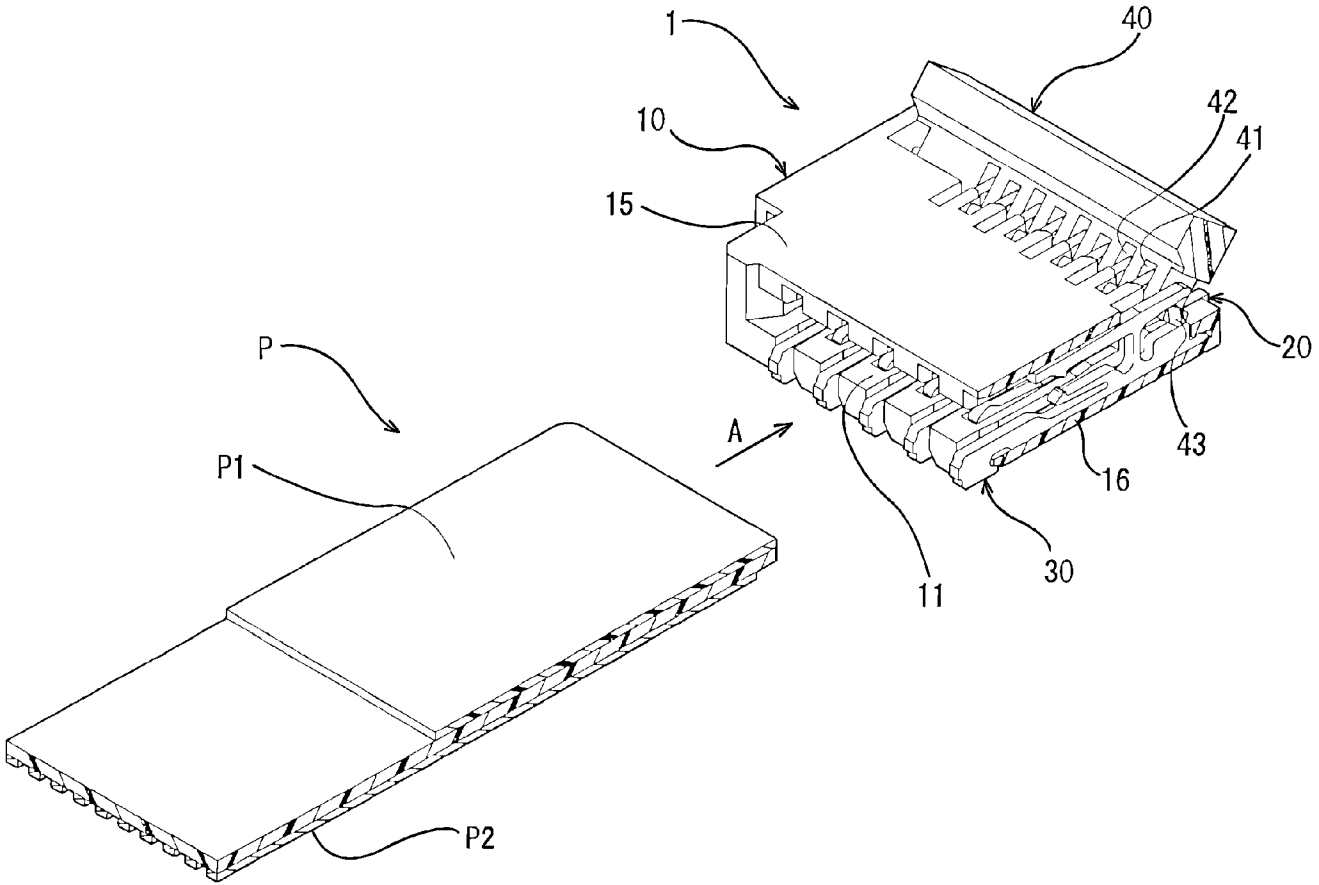

FIG. 1(A) is a sectional perspective view showing an electrical connector 1 (a connector) for a flat conductive member and the flat conductive member P to be connected to the connector 1, according to an embodiment of the present invention, cut along a plane perpendicular to a direction terminals are disposed (a terminal disposing direction) at a first terminal 20 (described later) is situated. And FIG. 1(B) is a sectional perspective view showing the connector 1 and the flat conductive member P to be connected to the connector 1, cut along a plane perpendicular to the terminal disposing direction at a second terminal 30 (described later) is situated. The first terminal 20 and the second terminal 30 may be referred to as "terminals 20, 30" inclusively, for convenience in explanation.

In the embodiment, the connector 1 includes a housing 10 made from a synthetic resin and having an approximate rectangular shape, a plurality of the terminals 20, 30 made from metal, being disposed and held in the housing 10 in a longitudinal direction of the housing 10, and a pressing member 40 made from a synthetic resin and attached to the housing 10 to be capable of rotating.

The terminals 20, 30 are made by punching a metal plate so as to maintain a plate surface of the metal plate. The first terminal 20 and the second terminal 30 have different shapes from each other. As shown in FIGS. 1(A) and 1(B), the first terminal 20 and the second terminal 30 are disposed alternately in the longitudinal direction of the housing 10 with the plate surfaces thereof in parallel.

In FIGS. 1(A) and 1(B), the flat conductive member P being inserted into the housing 10 in a direction of an arrow A is a flexible printed circuit board (FPC). The flat conductive member P includes a stiffener P1. The stiffener P1 is attached on an upper surface of a front portion of the flat conductive member P in a direction the flat conductive member P is inserted. The flat conductive member P further includes a corresponding circuit portion P2 arranged on a lower surface thereof. The corresponding circuit portion P2 extends in the direction the flat conductive member P is inserted, corresponding to each of the terminals 20, 30.

Figure 2A:
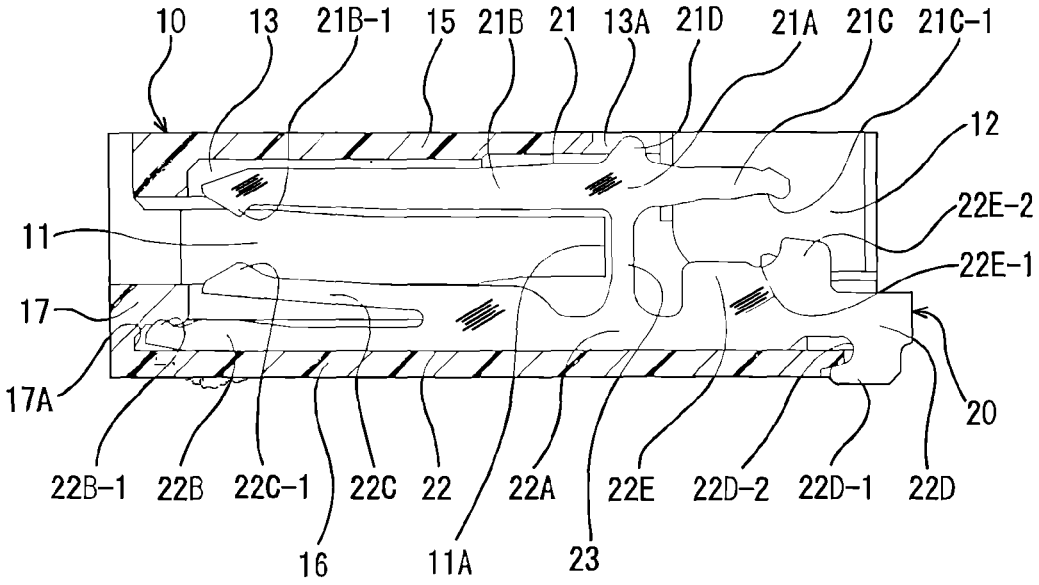
Figure 2B:
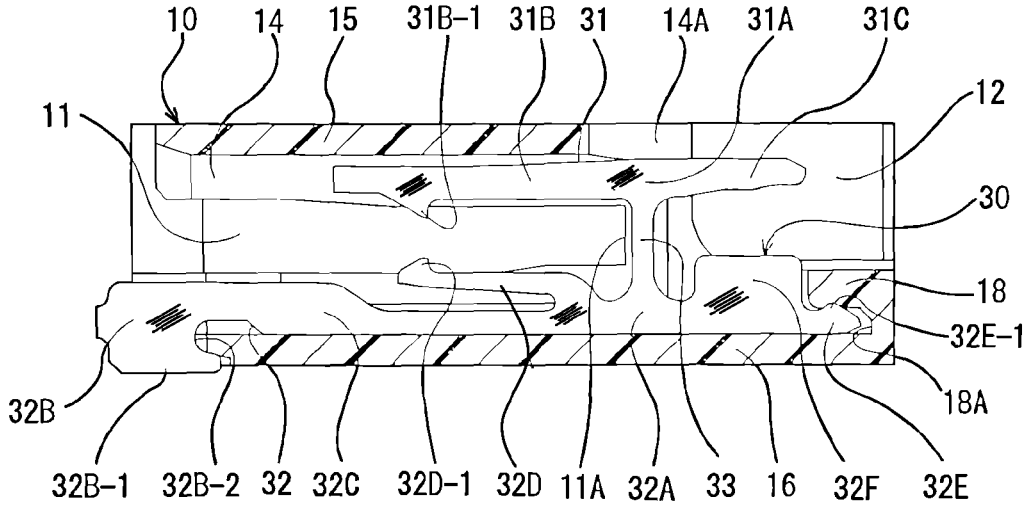

FIG. 2(A) is a sectional view showing the connector 1 taken along a plane parallel to the plate surface of the terminals 20, 30. In FIG. 2(A), the sectional view is taken where the first terminal 20 is situated, corresponding to FIG. 1(A), in which the connector 1 is cut where the first terminal 20 is situated. FIG. 2(B) is a sectional view showing the connector 1 taken along a plane parallel to the plate surface of the terminals 20, 30. In FIG. 2(B), the sectional view is taken where the second terminal 30 is situated, corresponding to FIG. 1(B), in which the connector 1 is cut where the second terminal 30 is situated. In FIGS. 2(A) and 2(B), the pressing member 40 is not shown for convenience in explanation.

The housing 10 includes a receptacle portion 11 for receiving the flat conductive member P. The receptacle portion 11 is a recessed portion in a side surface extending in the longitudinal direction of the housing 10, that is, the terminal disposing direction (a direction perpendicular to a sheet surface in FIGS. 2(A) and 2(B)). In addition, the receptacle portion 11 opens toward a left side of the sheet. The receptacle portion 11 extends to a middle portion of the housing 10 in the direction the flat conductive member P is inserted and extracted (a horizontal direction in FIGS. 2(A) and 2(B)). Further, in the terminal disposing direction, the receptacle portion 11 opens through a range where the terminals 20, 30 are disposed.

In addition, the housing 10 includes a terminal holding groove having a slit shape extending in a direction perpendicular to the terminal disposing direction (a direction parallel to the sheet surface in FIGS. 2(A) and 2(B)) and penetrating the housing 10 in the horizontal direction. The terminal holding groove is arranged with equal intervals in the terminal disposing direction.

As shown in FIGS. 2(A) and 2(B), the terminal holding grooves include a first terminal holding groove 13 for holding the first terminal 20 and a second terminal holding groove 14 for holding the second terminal 30. As shown in FIGS. 1(A) and 1(B), the first terminal holding groove 13 and the second terminal holding groove 14 are arranged alternately in the terminal disposing direction in the housing 10. Details about the first terminal holding groove 13 and the second terminal holding groove 14 will be described later. The first terminal holding groove 13 and the second terminal holding groove 14 may be referred to as "terminal holding grooves 13, 14" inclusively, for convenience in explanation.

In FIGS. 2(A) and 2(B), at a right side of the housing 10, upper half portions of the terminal holding grooves 13, 14 connect to each other in the terminal disposing direction, thus form a pressing member rotation space 12. In other words, the terminal holding grooves 13, 14 include an upper groove portion situated along an inner surface of an upper wall 15 at a left half side of the housing 10, a lower groove portion situated along an inner surface of a bottom wall 16, and a combining groove portion extending in a vertical direction for combining the upper groove portion and the lower groove portion at the middle portion of the housing 10 in the horizontal direction.

In addition, as shown in FIGS. 2(A) and 2(B), the housing 10 includes groove portions 13A, 14A in the right side of the upper wall 15 thereof, where the terminal holding grooves 13, 14 are situated, respectively. Accordingly, as shown in FIGS. 1(A) and 1(B), the upper wall 15 has a comb-like shape at an edge portion in the right side thereof. The groove portions 13A, 14A are in communication with the pressing member rotation space 12. Widths of the terminal holding grooves 13, 14 (dimensions of the terminal holding grooves 13, 14 in a thickness direction of the metal plate of the terminal) will be described later.

The housing 10 includes a wall 17 extending in an upper direction from a left end of the bottom wall 16. The wall 17 includes a fixing groove portion 17A for receiving a fixing portion 22B-1 (described later) of the first terminal 20. The fixing groove portion 17A is situated in an inner surface of the wall 17. The inner surface of the wall 17 extends in the vertical direction. The fixing groove portion 17A receives a thickness surface of the metal plate at an edge portion of the fixing portion 22B-1. The housing 10 further includes a wall 18 extending in the upper direction from a right end of the bottom wall 16. The wall 18 includes a fixing groove portion 18A for receiving a fixing portion 32E-1 (described later) of the second terminal 30. The fixing groove portion 18A is situated in an inner surface of the wall 18. The inner surface of the wall 18 extends in the vertical direction.

As shown in FIG. 2(A), the first terminal 20 is pressed and held in the first terminal holding groove 13 of the housing 10 with a thickness surface of the metal plate of a portion of an edge portion thereof. The first terminal 20 includes an upper arm portion 21, a lower arm portion 22, and a combining portion 23. The upper arm portion 21 and the lower arm portion 22 extend in parallel in the horizontal direction at an upper side and a lower side respectively. The upper arm portion 21 and the lower arm portion 22 are combined by the combining portion 23 at middle portions in the longitudinal direction thereof. The combining portion 23 extends in the vertical direction. Accordingly, the first terminal 20 has an approximate lateral H-character shape.

The upper arm portion 21 includes a pressing arm portion 21B extending toward the left side from a combined area 21A thereof. The combined area 21A is an area connected to the combining portion 23. The pressing arm portion 21B includes a pressing portion 21B-1 at a left end thereof. The pressing portion 21B-1 protrudes in a lower direction into the receptacle portion 11. As described later, the pressing portion 21B-1 displaces toward the lower direction as the upper arm portion 21 rotates around the combined area 21A along with a rotation of a cam portion 43 of the pressing member 40. Thereby, the pressing portion 21B-1 presses the upper surface of the flat conductive member P (not shown) being inserted into the receptacle portion 11 to the lower direction.

The upper arm portion 21 includes a pressed portion 21C extending from the combined area 21A into the pressing member rotation space 12 at the right side. The pressed portion 21C receives a force from the cam portion 43 (described later) of the pressing member 40. As described later, the pressed portion 21C includes a pressed recess portion 21C-1 at a lower edge of the right side thereof. The pressed recess portion 21C-1 has a recessed shape corresponding to the cam portion 43 capable of abutting against the cam portion 43.

In addition, the upper arm portion 21 includes a protrusion 21D protruding from the combined area 21A in the upper direction. The protrusion 21D enters into the groove portion 13A and does not protrude from an upper surface of the upper wall 15 to an outside the upper wall 15.

The lower arm portion 22 includes a held arm portion 22B extending toward the left side from a combined area 22A thereof. The combined area 22A is an area connected to the combining portion 23. The pressing arm portion 22B includes a fixing portion 22B-1 at a left end thereof. The pressing portion 22B-1 protrudes in the upper direction and includes an edge portion for fixing the first terminal 20 in the fixing groove portion 17A of the wall 17. The fixing portion 22B-1 is situated at the left side of the pressing portion 21B-1 of the upper arm portion 21.

The lower arm portion 22 further includes a contact arm portion 22C branched toward the upper direction from an upper edge portion of the held arm portion 22B. The contact arm portion 22C is branched from a position closer to the combined area 22A of the held arm portion 22B. The contact arm portion 22C is capable of being deformed and extends to the left side. The contact arm portion 22C extends to a position corresponding to a left edge of the pressing arm portion 21B of the upper arm portion 21 in the horizontal direction. The contact arm portion 22C includes a contact portion 22C-1 at a left end thereof. The contact portion 22C-1 protrudes in the upper direction into the receptacle portion 11. The contact portion 22C-1 is situated at the same position with the pressing portion 21B-1 of the pressing arm portion 21B in the horizontal direction. The pressing portion 21B-1 and the contact portion 22C protrude so as to close to each other in the vertical direction.

The lower arm portion 22 further extends to the right side from the combined area 22A and includes a connecting portion 22D at the right end thereof. The connecting portion 22D is to be soldered to a circuit board (not shown). A right edge portion of the connecting portion 22D protrudes from the housing 10. In addition, a lower end portion 22D-1 of the connecting portion 22D is situated at slightly lower side of a lower surface of the bottom wall 16 of the housing 10.

When the connector 1 is mounted on the circuit board, the lower end portion 22D-1 of the connecting portion 22D is connected to a corresponding circuit portion of the circuit board. The connecting portion 22D includes a fixing recess portion 22D-2. The fixing recess portion 22D-2 is fixed to a right edge portion of the bottom wall 16 with a thickness surface thereof.

The lower arm portion 22 includes a cam guide portion 22E between the combined area 22A and the connecting portion 22D thereof. As described later, the cam guide portion 22E guides the rotation of the cam portion 43 of the pressing member 40. The cam guide portion 22E is situated at a lower side of the pressed portion 21C of the upper arm portion 21. Further, the cam guide portion 22E includes a guide recess portion 22E-1 at the same position with the pressed recess portion 21C-1 of the pressed portion 21C in the horizontal direction. The guide recess portion 22E-1 supports the rotation of the cam portion 43.

The combining portion 23 has a narrower width than the upper arm portion 21 and the lower arm portion 22. The combining portion 23 is capable of an elastic deformation so as to incline.

As shown in FIG. 2(A), the first terminal 20 is pressed into the first terminal holding groove 13 from the right side when the first terminal 20 is fixed into the housing 10. Further, as the fixing portion 22B-1 of the held arm portion 22B of the first terminal 20 is pressed into the fixing groove portion 17A, the fixing recess portion 22D-2 of the connecting portion 22D is fitted into the right edge portion of the bottom wall 16. Accordingly, the first terminal 20 is held in the first terminal holding groove 13 with the thickness surfaces of the edge portions of the fixing portion 22B-1 and the fixing recess portion 22D-1.

As shown in FIG. 2(B), the second terminal 30 is pressed and held in the second terminal holding groove 14 of the housing 10 with a thickness surface of the metal plate of a partial edge portion thereof. The second terminal 30 includes an upper arm portion 31, a lower arm portion 32, and a combining portion 33. The upper arm portion 31 and the lower arm portion 32 extend in parallel in the horizontal direction at an upper side and a lower side respectively. The upper arm portion 31 and the lower arm portion 32 are combined by the combining portion 33 at middle portions in the longitudinal direction thereof. The combining portion 33 extends in the vertical direction. Accordingly, the second terminal 30 has an approximate lateral H-character shape. The combining portion 33 is situated at the same position with the combining portion 23 of the first terminal 20 in the horizontal direction.

The upper arm portion 31 includes a pressing arm portion 31B extending toward the left side from a combined area 31A thereof. The combined area 31A is an area connected to the combining portion 33. The pressing arm portion 31B is shorter than the pressing arm portion 21B of the first terminal 20. The pressing arm portion 31B includes a pressing portion 31B-1 at a left end thereof. The pressing portion 31B-1 protrudes in a lower direction into the receptacle portion 11.

As described later, the pressing portion 31B-1 displaces toward the lower direction as the upper arm portion 31 rotates around the combined area 31A along with the rotation of a cam portion 43 of the pressing member 40. Thereby, the pressing portion 31B-1 presses the upper surface of the flat conductive member P (not shown) being inserted into the receptacle portion 11 to the lower direction.

The upper arm portion 31 includes a pressed portion 31C extending from the combined area 31A into the pressing member rotation space 12 at the right side. The pressed portion 31C receives the force from the cam portion 43 (described later) of the pressing member 40. As described later, the pressed portion 31C is capable of abutting against the cam portion 43 at a lower edge of the right side thereof.

The lower arm portion 32 includes a connecting portion 32B extending toward the left side from a combined area 32A thereof. The combined area 32A is an area connected to the combining portion 23. The connecting portion 32B is to be soldered to the circuit board (not shown). A left edge portion of the connecting portion 32B protrudes from the housing 10. In addition, a lower end portion 32B-1 of the connecting portion 32B is situated at slightly lower side of a lower surface of the bottom wall 16 of the housing 10. When the connector 1 is mounted on the circuit board, the lower end portion 32B-1 of the connecting portion 32B is connected to a corresponding circuit portion of the circuit board. The connecting portion 32B includes a fixing recess portion 32B-2 for being fixed to a left edge portion of the bottom wall 16.

The lower arm portion 32 further includes an extending portion 32C between the combined area 32A and the connecting portion 32B thereof, extending in the horizontal direction. Being branched from an upper edge portion of the extending portion 32C, a contact arm portion 32D is formed and extends toward the upper direction. The contact arm portion 32D is branched from a position closer to the combined area 32A of the extending portion 32C. The contact arm portion 32D is capable of being deformed and extends to the left side. The contact arm portion 32D extends to the same position with the pressing portion 31B-1 of the upper arm portion 31 in the horizontal direction. The contact arm portion 32D includes a contact portion 32D-1 at a left end thereof. The contact portion 32D-1 protrudes in the upper direction into the receptacle portion 11.

Accordingly, the contact portion 32D-1 is situated at the same position with the pressing portion 31B-1 in the horizontal direction. The pressing portion 31B-1 and the contact portion 32D-1 are situated protruding so as to close to each other in the vertical direction.

As compared to FIG. 2(A) to FIG. 2(B), the pressing portion 31B-1 of the second terminal 30 is situated at the right side of the pressing portion 21B-1 of the first terminal 20. In addition, the contact portion 32D-1 of the second terminal 30 is also situated at the right side of the contact portion 22C-1 of the first terminal 20. Consequently, in the embodiment, the connector 1 contacts with the flat conductive member P being inserted at two positions in the horizontal direction. Accordingly, the terminals 20, 30 contact with the flat conductive member P at zigzag distributed positions. As a result, it is possible to make a contact stable as a whole.

The lower arm portion 32 also extends to the right side from the combined area 32A and includes a fixing portion 32E at the right end thereof. The second terminal 30 is fixed in the fixing groove portion 18A of the wall 18 with a thickness surface of an edge portion of the fixing portion 32E. The fixing portion 32E includes a fixing protrusion 32E-1 protruding in the upper direction.

The lower arm portion 32 includes a cam guide portion 32F between the combined area 32A and the fixing portion 32E thereof. The cam guide portion 32F has a protruding shape. The cam guide portion 32F is situated at a lower side of the pressed portion 31C of the upper arm portion 31. Further, the cam guide portion 32F includes an upper edge portion extending in the horizontal direction.

The combining portion 33 has a narrower width than the upper arm portion 31 and the lower arm portion 32. The combining portion 33 is capable of an elastic deformation so as to incline.

As shown in FIG. 2(B), the second terminal 30 is pressed into the second terminal holding groove 14 from the left side when the second terminal 30 is fixed into the housing 10. Further, as the fixing portion 32E of the second terminal 30 is pressed into the fixing groove portion 18A, the fixing recess portion 32B-2 of the connecting portion 32B is fitted into a left edge portion of the bottom wall 16. Accordingly, the second terminal 30 is held in the second terminal holding groove 14 with thickness surfaces of the edge portions of the fixing protrusion 32E-1 and the fixing recess portion 32B-2.

Figure 3A:
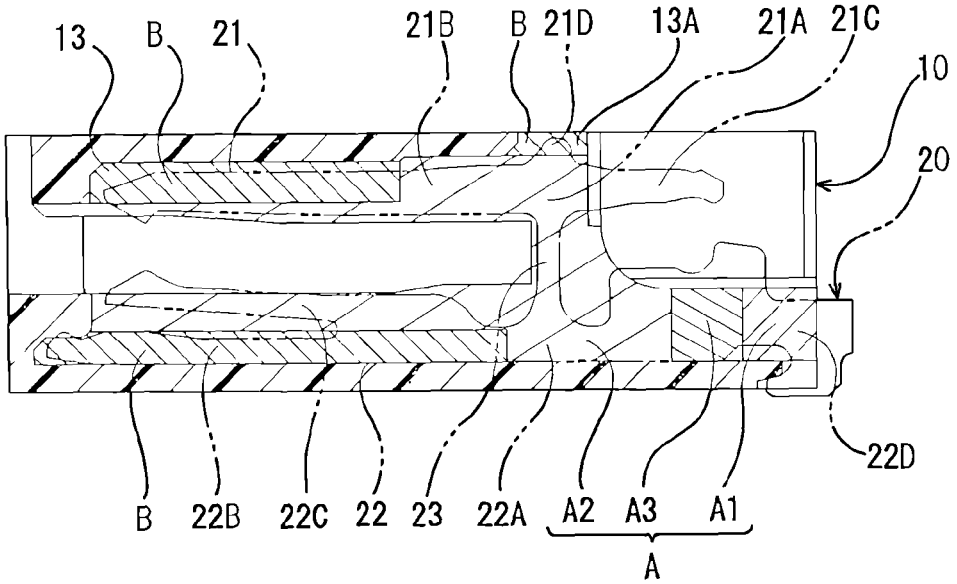

FIG. 3(A) is a sectional view showing the first terminal holding groove 13 of the housing 10, corresponding to FIG. 2(A). In FIG. 3(A), the first terminal 20 is shown with a projected line in order to understand a position corresponding to the first terminal holding groove 13 easier. The first terminal holding groove 13 includes a plurality of groove areas. Each of the groove areas has a different width in the terminal disposing direction. In FIG. 3(A), each of the groove areas is distinguished, shown as a different shaded area.

The first terminal 20 includes a first area composed of a whole area thereof, except an upper half portion of a left half portion of the pressing arm portion 21B, the protrusion 21D, the pressed portion 21C and the held arm portion 22B.

The first terminal holding groove 13 holds the first terminal 20 having the first area. The first terminal holding groove 13 includes a first groove portion A corresponding to the first area of the first terminal 20. The first groove portion A is composed of a whole area of the first terminal holding groove 13 except a lower half portion of a left half portion of the lower groove portion, an upper portion of the left half portion of the upper groove portion, and the groove portion 13A.

The first groove portion A includes three partial groove portions having different widths, respectively. More specifically, the first groove portion A includes a partial groove portion A1 corresponding to where the connecting portion 22D is provided in the first terminal 20, a partial groove portion A2 corresponding to an area from a left edge of the contact arm portion 22C to a left edge of the pressing arm portion 21B through the combined area 22A and the combining portion 23, and a partial groove portion A3 having a tapered width narrowing from the partial groove portion A1 to the partial groove portion A2. Accordingly, the partial groove portion A1 is wider than the partial groove portion A2 (refer to FIG. 5).

The first terminal 20 includes a second area composed of the upper half portion of the left half portion of the pressing arm portion 21B, the held arm portion 22B and the protrusion 21D. That is, the second area is composed of portions facing an inner surface of the first terminal holding groove 13, except the first area.

The first terminal holding groove 13 further includes a second groove portion B corresponding to the second area. The second groove portion B is composed of the lower half portion of the left half portion of the lower groove portion, the upper portion of the left half portion of the upper groove portion, and the groove portion 13A.

The second groove portion B has a width narrower than the first groove portion A. In the embodiment, the width of the second groove portion B is slightly wider than the thickness of the first terminal 20. Accordingly, there is a narrow space between the plate surface of the first terminal 20 and an inner surface of the second groove portion B. The second groove portion B guides the second area and controls a shift of the first terminal 20 in the thickness direction of the metal plate when the first terminal 20 is pressed into the first terminal holding groove 13.

As described above, in the embodiment, the second area is composed of the upper half portion of the left half portion of the pressing arm portion 21B and the protrusion 21D of the upper arm portion 21, and the held arm portion 22B of the lower arm portion 22. Accordingly, the second groove portion B corresponding to the second area controls the shift of the first terminal 20 in the thickness direction of the metal plate at three spots of the second area, that is, two spots in the upper arm portion 21 and one spot in the lower arm portion 22.

In the embodiment, the width of the second groove portion B is slightly wider than the thickness of the first terminal 20. For example, the width of the second groove portion B may be nearly equal to the thickness of the first terminal 20 and the second area of the first terminal 20 may be pressed into the second groove portion B.

Figure 3B:
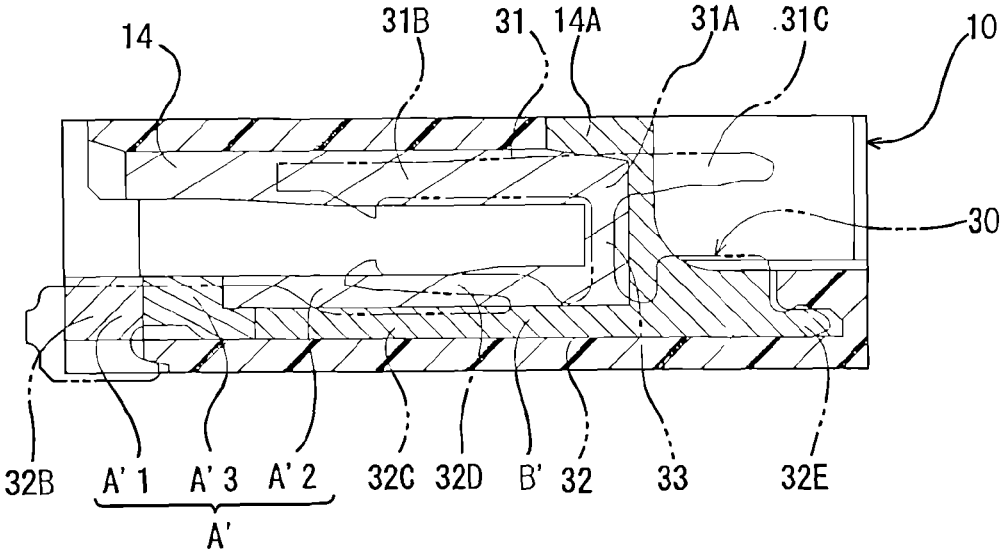

FIG. 3(B) is a sectional view showing the second terminal holding groove 14 of the housing 10, corresponding to FIG. 2(B). In FIG. 3(B), the second terminal 30 is shown with a projected line in order to understand a position corresponding to the second terminal holding groove 14 easier. As well as the first terminal holding groove 13, the second terminal holding groove 14 includes a plurality of groove areas. Each of the groove areas has a different width in the terminal disposing direction. In FIG. 3(B), as well as FIG. 3(A), each of the groove areas is distinguished, shown as a different shaded area.

The second terminal 30 includes a first area composed of the contact arm portion 32D, the combining portion 33, the combined area 31A and the pressing arm portion 31B of the upper arm portion 31 and a portion from a left portion of the extending portion 32C to the connecting portion 32B.

The second terminal holding groove 14 holds the second terminal 30 having the first area. The second terminal holding groove 14 includes a first groove portion A' corresponding to the first area. The first groove portion A' is composed of a left half portion of the lower groove portion, except a lower half portion of a middle portion in the horizontal direction, a left half portion of the combining groove portion and a lower half portion of the upper groove portion.

The first groove portion A' includes three partial groove portions having different widths, respectively. More specifically, the first groove portion A' includes a partial groove portion A'1 corresponding to where the connecting portion 32B is provided in the second terminal 30, a partial groove portion A'2 corresponding to an approximate lateral U-shape area composed of an area from the combined area 31A to a left end of the pressing arm portion 31B, the combining portion 33, and the contact arm portion 32D. The first groove portion A' further includes a partial groove portion A'3 having a tapered width narrowing from the partial groove portion A'1 to the partial groove portion A'2. Accordingly, the partial groove portion A'1 is wider than the partial groove portion A'2 (refer to FIG. 5).

The second terminal 30 includes a second area composed of an area from the left portion of the extending portion 32C to the fixing portion 32E and the portion of the pressed portion 31C next to the combined area 31A. That is, the second area is composed of portions facing an inner surface of the second terminal holding groove 14, except the first area.

The second terminal holding groove 14 further includes a second groove portion B' corresponding to the second area. The second groove portion B' is composed of an area extending along the partial groove portion A'2 from a left portion of the lower half portion in the left half portion of the lower groove portion to the groove portion 13B, and a right half portion of the lower groove portion.

The second groove portion B' has a width narrower than the first groove portion A'. In the embodiment, the width of the second groove portion B' is slightly wider than the thickness of the second terminal 30. Accordingly, there is a narrow space between the plate surface of the second terminal 30 and an inner surface of the second groove portion B'. The second groove portion B' guides the second area and controls a shift of the second terminal 30 in the thickness direction of the metal plate when the second terminal 30 is pressed into the second terminal holding groove 14.

Figure 4:
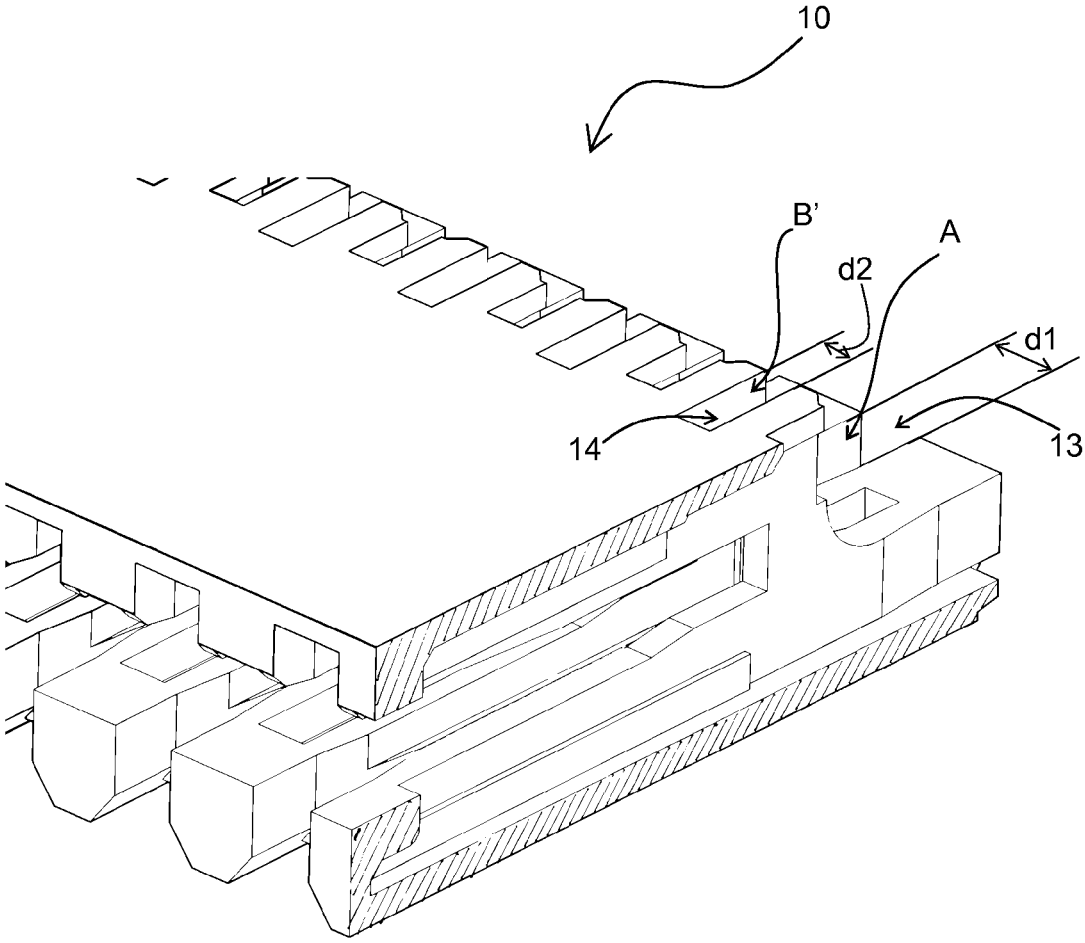
FIG. 4 is an enlarged sectional view showing the housing of the connector according to the embodiment of the present invention.

FIG. 4 is an enlarged sectional view showing the housing 10 of the connector 1 according to the embodiment of the present invention.

As shown in FIG. 4, the housing 10 of the connector 1 includes the first terminal holding groove 13 for holding the first terminal 20 and the second terminal holding groove 14 for holding the second terminal 30. Further, the first terminal holding groove 13 and the second terminal holding groove 14 are arranged alternately in the terminal disposing direction in the housing 10.

As described above, in the embodiment, the first terminal holding groove 13 includes the first groove portion A corresponding to the first area of the first terminal 20, and the second terminal holding groove 14 includes the second groove portion B' corresponding to the second area of the second terminal 30. Note that the first terminal holding groove 13 also includes the second groove portion B corresponding to the second area of the first terminal 20, and the second terminal holding groove 14 includes the first groove portion A' corresponding to the first area of the second terminal 30.

As shown in FIG. 4, the first groove portion A has a width d1, and the second groove portion B' has a width d2. Note that the first groove portion A' has a width substantially the same as the width d1, and the second groove portion B has a width substantially the same as the width d2. In the embodiment, the connector 1 is configured such that the width d1 is larger than the width d2.

Figure 5:
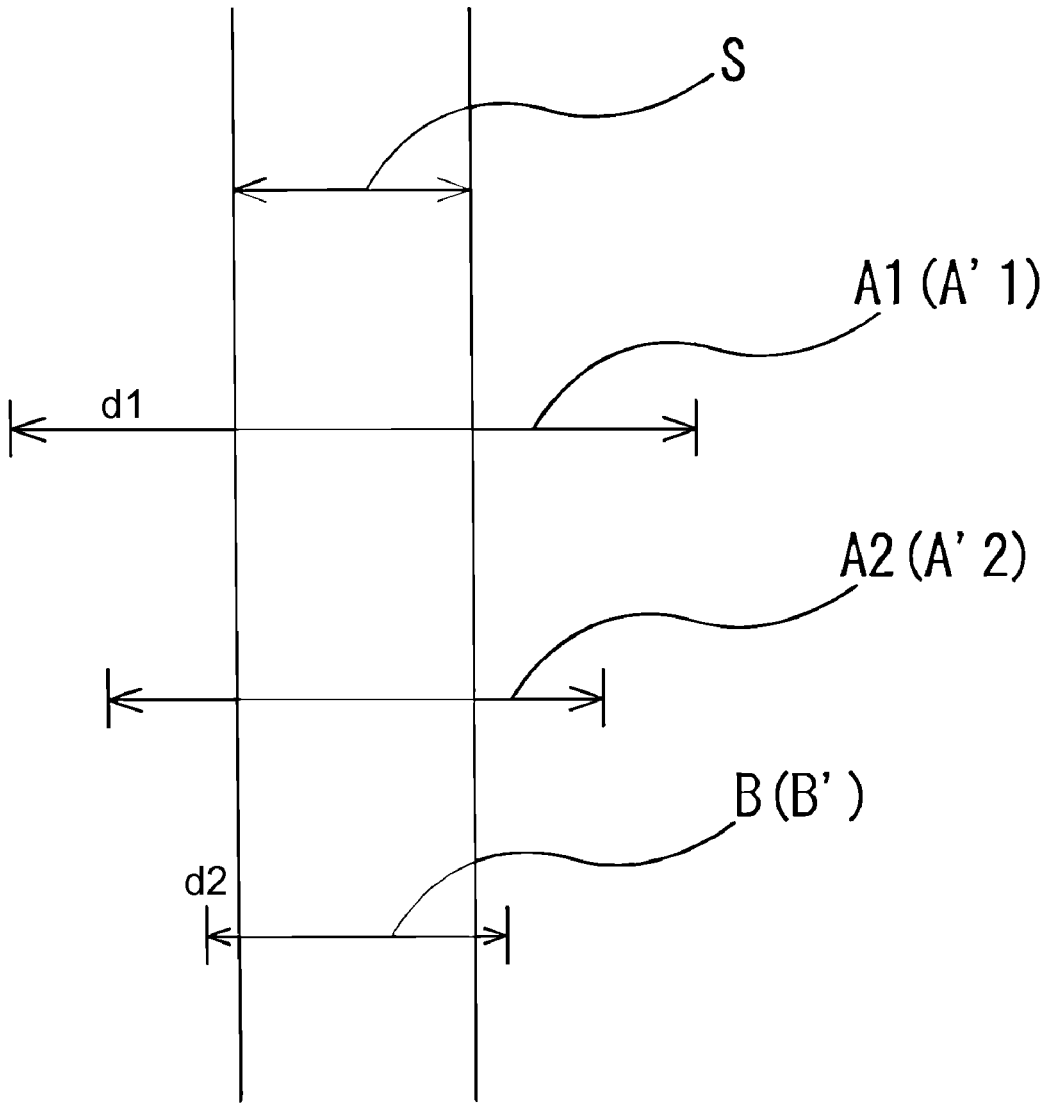
FIG. 5 is a schematic view showing inner widths of the first terminal holding groove and the second terminal holding groove, comparing with a thickness of the terminal according to the embodiment of the present invention.

FIG. 5 is a schematic view showing widths of the partial groove portions A1, A2 of the first groove portion A and the second groove portion B, as well as showing widths of the partial groove portions A1', A2' of the first groove portion A' and the second groove portion B' comparing to a thickness of the terminals 20, 30.

As shown in FIG. 5, the thickness of the terminals 20, 30 is shown as "S". The partial groove portions A1 and A2 have widths wider than the thickness of the first terminal 20. The partial groove portion A1 has the width d1, and the second groove portion B has the width d2 shown in FIG. 4. When the first terminal 20 is held in the first terminal holding groove 13, a space is formed between the plate surface of the first terminal 20 and inner surfaces of the partial groove portions A1, A2, and A3.

As shown in FIG. 5, the partial groove portions A'1 and A'2 have widths wider than the thickness of the second terminal 30. The partial groove portion A'1 has the width d1, and the second groove portion B' has the width d2 shown in FIG. 4. When the second terminal 30 is held in the second terminal holding groove 14, a space is formed between the plate surface of the second terminal 30 and inner surfaces of the partial groove portions A'1, A'2, and A'3.

As described above, in the embodiment, the second area is composed of the portion next to the combined area 31A of the pressed portion 31C in the upper arm portion 31 and the area from a left portion of the extending portion 32C to the fixing portion 32E in the lower arm portion 32. Accordingly, the lower arm portion 32 has two second areas in both of the left half portion and the right half portion. Consequently, the second groove portion B' corresponding to the second area controls the shift of the second terminal 20 in the thickness direction of the metal plate at three spots of the second area, that is, one spot in the upper arm portion 31 and two spots in the lower arm portion 32.

In the embodiment, the width of the second groove portion B' is slightly wider than the thickness of the second terminal 30. For example, the width of the second groove portion B' may be nearly equal to the thickness of the second terminal 30 and the second area of the second terminal 30 may be pressed into the second groove portion B' so that the plate surface of the second area is pressed with the inner surface of the second groove portion B'.

The pressing member 40 is made from an insulating material such as a resin. As shown in FIGS. 1(A) and 1(B), the pressing member 40 extends from an inside to an outside of the housing 10. The pressing member 40 has a width over a range the terminals 20, 30 are disposed.

The pressing member 40 includes groove portions 41, 42 having a slit shape. The pressing member 40 provides the groove portions 41, 42 in a half of a portion thereof situated in the pressing member rotation space 12. The groove portions 41, 42 are also situated at positions corresponding to the terminals 20, 30 in the terminal disposing direction and allow the pressed portions 21C, 31C of the terminals 20, 30 to penetrate therethrough. The groove portions 41, 42 are combined by the cam portion 43 situated at an edge portion of the pressing member 40. The cam portion 43 combines facing inner surfaces or inner surfaces facing each other in the terminal disposing direction of the groove portions 41, 42.

When the pressing member 40 is at an open position, that is, when the pressing member 40 extends in the upper direction, the cam portion 43 has an oval cross-sectional surface with a longer side extending in the direction the flat conductive member P is inserted and extracted. When the pressing member 40 is at a closed position, that is, the pressing member 40 extends toward a right side in FIGS. 1(A) and 1(B), the cam portion 43 has the oval cross-sectional surface with the longer side extending in a height direction of the connector 1.

A dimension of a shorter side of the cross-sectional surface of the cam portion 43 is shorter than a distance between the guide recess portion 22E-1 and the pressed recess portion 21C-1 of the first terminal 20, and shorter than a distance between the upper edge portion of the cam guide portion 32F and a lower edge of the pressed portion 31C of the second terminal 30. Further, a dimension of the longer side of the cross-sectional surface of the cam portion 43 is longer than the distance between the guide recess portion 22E-1 and the pressed recess portion 21C-1 of the first terminal 20, and longer than the distance between the upper edge portion of the cam guide portion 32F and a lower edge of the pressed portion 31C of the second terminal 30.

Next, an operation of the connector 1 will be explained with reference to FIGS. 2(A) and 2(B). First, the connecting portion 22D of the first terminal 20 and the connecting portion 32B of the second terminal 30 of the connector 1 are soldered to the corresponding circuit portions on the circuit board.

Next, when the pressing member 40 of the connector 1 is at the open position, the flat conductive member P is inserted into the receptacle portion 11. A front edge portion (a right edge portion in FIGS. 1(A) and 1(B)) of the flat conductive member P passes between the pressing portion 21B-1 and the contact portion 22C-1 of the first terminal 20, and between the pressing portion 31B-1 and the contact portion 32D-1 of the second terminal 30. Then the front edge portion of the flat conductive member P abuts against a back wall portion 11A of the receptacle portion 11, thereby completing an insertion of the flat conductive member P. When the flat conductive member P is completely inserted, the corresponding circuit portion P2 arranged on the lower surface of the flat conductive member P is situated over the contact portion 22C-1 and the contact portion 32D-1.

Next, the pressing member 40 at the open position is rotated to the closed position. As the pressing member 40 is rotated, the guide recess portion 22E-1 of the cam guide portion 22E of the first terminal 20 and the cam guide portion 32F of the second terminal 30 guides the rotation of the cam portion 43 to the closed position with upper edge portions thereof.

After the rotation starts, an edge portion of the cam portion 43 pushes the pressed portion 21C of the upper arm portion 21 and the pressed portion 31C of the upper arm portion 31 toward the upper direction. Therefore, the combining portion 23 of the first terminal 20 and the combining portion 33 of the second terminal 30 incline elastically toward the left side in FIGS. 2(A) and 2(B). Accordingly, the upper arm portion 21 of the first terminal 20 and the upper arm portion 31 of the second terminal 30 incline around the combined areas 21A and 31A as pivot points, respectively. As a result, left end portions of the upper arm portion 21 of the first terminal 20 and the upper arm portion 31 of the second terminal 30 displace toward the lower direction.

Consequently, the pressing portion 21B-1 and the pressing portion 31B-1 displace toward the lower direction and press the upper surface of the flat conductive member P toward the lower direction, since the pressing portions 21B-1 and 31B-1 are situated at the left end portions of the upper arm portions 21 and 31, respectively. The corresponding circuit portion P2 arranged on the lower surface of the flat conductive member P presses the contact portion 22C-1 of the contact arm portion 22C and the contact portion 32D-1 of the contact arm portion 32D from the upper direction, since the pressing portions 21B-1 and 31B-1 press the flat conductive member P, as described above. Accordingly, the contact arm portions 22C and 32D displace toward the lower direction.

When the pressing member 40 reaches the closed position and the rotation thereof is completed, the cam portion 43 of the pressing member 40 keeps pressing the pressed portions 21C and 31C upward, having a position with the longer side of the oval cross-sectional surface thereof extending in the vertical direction.

When the pressing member 40 is at the closed position, the terminals 20, 30 maintain a state that the pressing portions 21B-1 and 31B-1 thereof press against the flat conductive member P, respectively. Accordingly, it is possible to maintain a state that the corresponding circuit portion P2 of the flat conductive member P contacts with a contact pressure, with the contact portions 22C-1 and 32D-1 respectively. As a result, the flat conductive member P and the circuit board can obtain an electrical connection through the connector 1.

In the embodiment, the second groove portion B corresponds to the second area provided at two spots in the upper arm portion 21 and at one spot in the lower arm portion 22 of the first terminal 20. In addition, the second groove portion B' corresponds to the second area provided at two spots in the upper arm portion 31 and at two spots in the lower arm portion 32 of the second terminal 30. Accordingly, the terminals 20, 30 are controlled the shifts in the thickness direction thereof with three spots arrange over whole areas thereof, respectively.

As a result, the terminals 20, 30 can obtain stable positions in the thickness direction thereof and can keep proper positions, respectively. Consequently, the terminals 20, 30 can hardly waggle or buckle, thereby obtaining the space having a proper width between the inner surfaces of the first groove portions A, A' and the plate surfaces of the first areas thereof, respectively. Accordingly, a capillary action does not occur within the spaces. Therefore, it is possible to prevent flux from flowing into the first area considerably. As a result, the upper arm portions 21, 31 of the terminals 20, 30 can remain movable. Further, the flux does not adhere to surfaces of the terminals 20, 30, thereby maintaining the surfaces of the terminals 20, 30 in good condition.

Further, in the embodiment, the first groove portions A, and A' correspond to the first areas where the connecting portions 22D, 32D are provided in the terminals 20, 30, respectively. In addition, the first groove portions A, A' have the widths wider than the thickness of the terminals 20, 30, respectively. Accordingly, the terminals 20, 30 can obtain the space having a right width between the inner surfaces of the first groove portions A, A' and the connecting portions 22D, 32B thereof, respectively. Thus, the flux does not flow up along the connecting portions 22D, 32B when the connecting portions 22D, 32B are soldered to the circuit board. As a result, it is possible to prevent the flux from flowing up thoroughly.

In the embodiment, the terminals 20, 30 include the second areas situated next to the combined areas 21A, 31A of the upper arm portions 21, 31 and next to the combined areas 22A, 32A of the lower arm portions 22, 32 respectively. As described above, the terminals 20, 30 are controlled the shifts in the thickness direction thereof at close positions to the first areas, since the first areas include the combined areas 21A, 31A, 22A and 32A and the second areas are provided next to the combined areas 21A, 31A, 22A and 32A. Consequently, the shifts of the terminals 20, 30 can be controlled more effectively and the terminals 20, 30 can stay in the proper positions, respectively.

In the embodiment, the second groove portion is provided corresponding to the second area provided at three spots in the terminal. The second area and the second groove portion corresponding to the second area may be provided more than three spots, respectively. As the terminal is controlled at more spots, the terminal can be situated to the proper position in the thickness direction more certainly, being supported at broader area thereof. It is preferable that each of the upper arm portion and the lower arm portion includes the second area having the corresponding second groove portion, in other words, in order to maintain the terminal in the proper positions in the thickness direction more stably, it is preferable to arrange the spots controlling the terminal in the thickness direction over the whole area of the terminal.

In the embodiment, the flat conductive member P obtains an electrical connection to the terminals 20, 30 through contacts of the corresponding circuit portion P2 arranged on the lower surface thereof and the contact portions 22C-1, 32D-1 (a bottom contact). It is not limited to the bottom contact to obtain the electrical connection. For example, the corresponding circuit portion may be arranged on the upper surface of the flat conductive member P and may contact with the pressing portions 21B-1, 31B-1 of the terminals 20, 30 (an upper contact). Further, both of the bottom contact and the upper contact may be obtained with the corresponding circuit portions arranged on both of the upper and lower surfaces of the flat conductive member P. Furthermore, the bottom contact and the upper contact may be obtained alternately in the terminal disposing direction.

In the embodiment, the first terminal and the second terminal are disposed alternately. The first terminal may be disposed solely without the second terminal, or the second terminal may be disposed solely without the first terminal. When only the first terminal is provided, the first terminal holding groove corresponding to the first terminal is provided in the housing. When only the second terminal is provided, the second terminal holding groove corresponding to the second terminal is provided in the housing. As a result, it is possible to prevent the flux from flowing into the first terminal holding groove and the second terminal holding groove certainly.

In the embodiment, the connector is so-called a back flip type connector and the terminal has a lateral H-character shape opening and closing along with the rotation of the pressing member. The connector is not limited to the back flip connector.

For example, the connector may be so-called a front flip type connector in which the terminal may have a lateral U-character shape combining one end of the upper arm portion and one end of the lower arm portion with the combining portion and may open and close by the rotation of the pressing member provided where the other ends are situated. Further, the connector may be so-called a Non-ZIF type connector, in which the flat conductive member is inserted with a low insertion force between the upper arm portion and the lower arm portion of the terminal having a lateral U-shape.

The disclosure of Japanese Patent Application No. 2009-011864, filed on Jan. 22, 2009 is incorporated in the application by reference.

While the invention has been explained with reference to the specific embodiments of the invention, the explanation is illustrative and the invention is limited only by the appended claims.

What is claimed is:

1. An electrical connector for connecting a flat conductive member, comprising:

a housing made of an electrical insulating material and including a plurality of terminal holding grooves arranged next to each other along a specific direction, said housing further including a receptacle portion at a front side thereof for receiving the flat conductive member, each of said terminal holding grooves including a first groove portion and a second groove portion, said first groove portion having a first groove width in the specific direction, said second groove portion having a second groove width in the specific direction smaller than the first groove width;

a pressing member disposed at a rear side of the housing opposite to the front side and capable of rotating relative to the housing between an open position for inserting the flat conductive member and a closed position for pressing the flat conductive member; and a terminal held in each of the terminal holding grooves for contacting with the flat conductive member, said terminal including an upper arm portion, a lower arm portion extending in parallel with the upper arm portion, and a combining portion combining the upper arm portion and the lower arm portion, said lower arm portion including a connecting portion accommodated in the first groove portion and to be soldered to a circuit board, said upper arm portion including a pressing portion for pressing the flat conductive member.

2. The electrical connector according to claim 1, wherein at least one of said upper arm portion and said lower arm portion includes a portion fitted in the second groove portion.

3. The electrical connector according to claim 1, wherein at least one of said upper arm portion and said lower arm portion includes one portion fitted in the second groove portion, and the other of said upper arm portion and said lower arm portion includes two portions fitted in the second groove portion.

4. The electrical connector according to claim 1, wherein at least one of said upper arm portion and said lower arm portion includes a protrusion fitted in the second groove portion.

5. The electrical connector according to claim 1, wherein said terminal includes a first terminal and a second terminal disposed in the housing alternately.

6. The electrical connector according to claim 1, wherein said housing is formed in a substantially rectangular shape with a long side aligned with the specific direction.

7. The electrical connector according to claim 1, wherein said housing further includes an upper wall and a lower wall opposite to the upper wall, said second groove portion having an opening portion in the upper wall at the rear side of the housing.

8. The electrical connector according to claim 1, wherein said first groove portion and said second groove portion are situated at the rear side of the housing.

9. The electrical connector according to claim 1, wherein said pressing member includes a cam portion for pushing the upper arm portion against the flat conductive member at the closed position.

10. The electrical connector according to claim 9, wherein at least one of said upper arm portion and said lower arm portion includes a pressed portion for receiving a force from the cam portion, a branched arm with a contact portion for contacting with the flat conductive member, and a cam guide portion for guiding the cam portion.

* * * * *